United States Patent [19]

Briskin

[11] 4,019,521

[45] Apr. 26, 1977

[54] SMOKABLE MATERIAL AND METHOD FOR PREPARING SAME

[75] Inventor: Theodore S. Briskin, Beverly Hills, Calif.

[73] Assignee: Philip Morris Incorporated, New York, N.Y.

[22] Filed: Mar. 27, 1975

[21] Appl. No.: 562,735

Related U.S. Application Data

[63] Continuation of Ser. No. 367,447, June 6, 1973, abandoned.

[52] U.S. Cl. ..... 131/2

[51] Int. Cl.[2] ..... A24B 15/00

[58] Field of Search ..... 131/2, 15, 17, 140 C

[56] References Cited

UNITED STATES PATENTS

| | | | |
|---|---|---|---|
| 2,907,686 | 12/1954 | Siegel | 131/2 |
| 3,447,539 | 6/1969 | Briskin et al. | 131/2 |
| 3,545,448 | 12/1970 | Mormon et al. | 131/2 |
| 3,640,285 | 2/1962 | Briskin et al. | 131/2 |

*Primary Examiner*—Robert W. Michell
*Assistant Examiner*—V. Millin

[57] ABSTRACT

A smokable material formed by heating a cellulosic or carbohydrate material at a temperature within the range of 150°–750° C in an inert, non-oxidizing atmosphere for a time sufficient to effect a weight loss of at least 60% but not more than 90%.

5 Claims, No Drawings

SMOKABLE MATERIAL AND METHOD FOR PREPARING SAME

This is a continuation, of application Ser. No. 367,447 , filed June 6, 1973 now abandoned.

This invention relates to a smokable material for use as a filler in the manufacture of cigars, cigarettes and smoking tobacco and it relates more particularly to a new and improved method for the preparation of same.

In the copending application Ser. No. 339,148, filed Mar. 8, 1973, now U.S. Pat. No. 3,861,401, and entitled "Smokable Material and Method," which application is incorporated herein by reference, description is made of the method for preparation of a smokable product wherein a cellulosic material, containing 3–15% by weight of calcium and/or magnesium oxalate, is heated to a temperature within the range of 275°–375° C until a weight loss within the range of 60°–75% has been experienced.

It has been found, in accordance with the practice of this invention, that the thermal degradation of the cellulosic material, to produce an improved smokable product, can be achieved when the cellulosic material is also subjected to thermal treatment in an inert, non-combustible atmosphere. Under such conditions, the thermal degradation temperature can be increased to as much as 600°–750° C, thereby greatly to reduce the time required to achieve the desired thermal degradation of the cellulosic material, while at the same time producing a more purified, better tasting and more acceptable smokable product.

The marked reduction in time of thermal treatment represents a significant factor in the commercial acceptance of the material as a tobacco substitute, since such treatment enables continuous mass production at low cost whereby use of the tobacco substitute is more compatible with current commercial practice.

When thermal treatment of the cellulosic material is carried out at higher temperature in a non-oxidizing or inert atmosphere it is no longer necessary to make use of calcium or magnesium oxalate or other catalyst to achieve a commercial rate of production, although such catalytic agents can still be employed, as described in the aforementioned copending application.

A smokable product characterized by improved taste, burning rate, and other smoking properties, characteristic of the smokable material produced in accordance with the practice of this invention, can be obtained when the cellulosic material is heated in an inert or non-oxidizing atmosphere at a temperature with the range of 150°–750° C but, in the absence of catalyst, the time required at temperatures within the lower portion of the above range is commmercially excessive, such that it is preferred to make use of a temperature within the range of 350°–750° C and preferably a temperature within the range of 400°–700° C. Under these conditions, the time required to achieve the desired thermal treatment will be but a few minutes at a temperature within the upper part of the range (700°–750° C) to 2–4 minutes at a temperature within the range of 500°–700° C and 4–10 at a temperature within the range of 350°–500° C.

As the inert atmosphere in which the thermal treatment is carried out, it is preferred to make use of nitrogen gas, although use can be made of other inert, non-oxidizing gases, such as carbon dioxide, helium and the like. The desired result can be achieved by heat treatment of the cellulosic material, at the desired temperature, in an enclosed chamber whereby the oxygen present in the air entrapped within the chamber, along with the cellulosic material, is quickly reduced to a level wherein non-oxidizing conditions prevail to enable rapid heating of the cellulosic material under otherwise combustible temperatures. Instead, the non-oxidizing atmosphere can be achieved by effecting the thermal treatment of the cellulosic or carbohydrate material under vacuum conditions.

As the cellulosic material, can be made of alphacellulose or other forms of cellulose, such as wood pulp, paper pulp, straw, flax, bamboo, cotton, hemp, rice fibers, and vegetable fibers, plant leaves and the like. Instead of cellulosic materials of the type described, a tobacco substitute can be produced in accordance with the practice of this invention by applying the described heat treatment to other cellulosic derivatives, such as methyl cellulose, carboxymethyl cellulose and the like, and other carbohydrate materials such as starch, pectin, polyvinyl alcohol, gum, alginates and the like, all of which are hereinafter included within the term "carbohydrate material".

The cellulose or carbohydrate material can be subjected to the described thermal treatment, in the non-oxidizing atmosphere, in the form of powders or discrete particles such as shreds, but it is preferred to carry out the described thermal treatment while the cellulosic or carbohydrate material is in sheet or fabric form.

In a batch operation, the material is merely loaded into an enclosed chamber in which the desired atmospheric conditions can be provided, as by the replacement of air with nitrogen or carbon dioxide, or gradual heating of the material until the oxygen content is reduced to a level insufficient to support combustion. Thereafter the material is heated to the temperature for thermal degradation and maintained at such temperature for the desired length of time. For mass production at low cost, it is preferred to carry out the thermal treatment in a continuous process wherein the powdered or particulate carbohydrate or cellulosic material is distributed as a thin layer on a supporting surface, such as an endless wire or metal belt on which the powdered or particulate material is carried through the inert, enclosed heated space at a rate sufficient to achieve the desired amount of thermal degradation. When the cellulosic material or carbohydrate is provided in the form of a continuous sheet having sufficient mass integrity to be self-supporting, it can be continuously advanced at the desired linear speed through an inert, enclosed space heated to the desired elevated temperature.

An improved smokable product, having the desired characteristics and purity, will be produced when the cellulosic or carbohydrate material experiences a weight loss during heat treatment of better than 50% and preferably more than 60% but less than 90% and preferably less than 80%, under the conditions described.

The product obtained from the described thermal treatment will be grayish-black in color. If processed in sheet form, the product issuing from the heat treating chamber usually is still in the form of a sheet having sufficient mass integrity and flexibility to enable incorporation of additives, and to enable processing to the final smokable product. The incorporation of additives is desired for improvemnt in strength, taste, aroma, ashing characteristics, glow or burning properties, as well as color.

To improve mass integrity and strength, addition can be made of a binder in the amount of ½–5% by weight of the treated carbohydrate or cellulosic material and preferably in an amount within the range of 2–4% by weight. For this purpose, it is preferred to make use of a gum, such as guar gum, gum tragacanth, and the like natural gums; cellulose derivatives such as methyl cellulose, carboxymethyl cellulose, hydroxyethyl cellulose and the like, and preferably water soluble cellulosic derivatives or resins.

The mass integrity and strength is further enhanced by incorporation of a polyalkylene carbonate, such as polyvinylene carbonate, described in the copending application Ser. No. 252,003. This resin is preferred for a number of reasons such as:

(1) polyvinylene carbonate forms a very strong and flexible sheet which burns cleanly without introducing undesirable ordor or taste;

(2) the reconstituted sheet treated with the polyvinylene carbonate is relatively water resistant thereby to militate against leaching of water soluble additives;

(3) the polyvinylene carbonate serves as a vehicle for coloring agents coated onto the treated material;

(4) it improves the stability of the smokable material during storage and helps maintain the desired moisture balance therein.

It is also desirable to incorporate a humectant to keep the smoking material moist and pliable and to enhance the packing characteristics as well as the burning characteristics of the product. For this purpose, use can be made of a polyhydric alcohol, such as glycerol or a glycol, represented by ethylene glycol, propylene glycol and the like, inositol, butane diol and the like hydroscopic materials and mixtures thereof. These materials can be applied by spraying from water solution onto the sheet of particulates, or by admixture with the treated cellulosic or carbohydrate material. Addition is made in amounts up to 10% by wieght and preferably within the range of 1–4% by weight, when added.

The glow and ashing characteristics of the smoking material can be improved by the addition of water soluble alkali metal salts, such as sodium or potassium salts of low molecular weight hydroxy acids, such as oxalic, citric, meleic, pivalic and the like organic acids, or carbonates, bicarbonates or phosphates, such as potassium citrate, sodium citrate, potassium bicarbonate, potassium maleate and dihydrogen sodium phosphate, and mixtures thereof. Such mineralizing agents or ashing ingredients, when employed, may be incorporated in amounts up to 30% by weight of the smokable material and preferably in an amount within the range of 5–10% by weight.

From the standpoint of appearance, it is desirable for the smoking material to have a dark brownish color, corresponding to that of rich cured tobacco. The dark gray material resulting from the thermal treatment of this invention is not readily colored by conventional dyestuffs unless employed in undesirable enormous amounts. It has been found that novel use, as a coloring material, can be made of triquinonyl $C_6O_6 \cdot 8H_2O$, described in the copending application Ser. No. 252,003, which produces a strong orange to brown color with calcium or magnesium present in the cellulosic or carbohydrate product thereby to provide a non-leachable color that is effective to convert the thermally treated product to a rich brown color.

Flavor and aroma can be improved by the addition of flavoring agents, such as nicotine, menthol, chlorogenic, caffeic and quinic acids, essential oils, tobacco extracts and the like.

The following examples are given by way of illustration, but not by way of limitation, of the practice of this invention in the manufacture of a smokable product:

EXAMPLE I

A sheet formed of alpha-cellulose fibers containing 8–10% calcium carbonate, is advanced continuously through an enclosed space in which an inert atmosphere is maintained by the continuous introduction of nitrogen gas through an inlet located approximately at the center of the space to replace gas escaping from the space through openings at the inlet and outlet, through which the sheet passes. The space is maintained at a temperature of about 400° C and the linear speed of the sheet is adjusted to provide for exposure to the elevated temperature for about 5 minutes. The sheet experiences a weight loss of between 60–70%, as a result of the heat treatment, and it issues as a dark gray colored sheet.

The heat treated sheet can be shredded to form a filler capable of being used alone or in admixture with cured tobacco for use as a filler in cigarettes or cigars which will burn with a desirable glow at the tip at a burning rate commensurate with normal cigarettes and with an ash that clings until flicked from the burned end. The cigarette or cigar burns with an extremely mild tastee and without undesirable odor.

EXAMPLE 2

Instead of making use of an endless sheet of callulosic material, a carbohydrate such as alpha-cellulose, carboxymethyl cellulose, cellulose acetate, gum or the like can be reduced to powdered or particulate form and loaded into a batch overn heated to a temperature of about 400°–500° C for a time sufficient to achieve a weight reduction on the order of 60–75%. Inert conditions are maintained within the sealed enclosure as by purging the enclosure with carbon dioxide or nitrogen.

The thermally treated product can be compounded alone or in combination with cured tobacco and with other additives such as described in the following examples, to provide a smoking product which can be used in the fabrication of cigars and cigarettes.

EXAMPLE 3

To 100 grams of thermally treated product of Example 1 or Example 2 addition is made of 1.2 ml of an aqueous solution containing 60 mg of potassium citrate, 12 mg sodium citrate, 12 mg disodium hydrogen phosphate, 18 mg sodium bicarbonate, 30 mg inositol and 30 mg glycerine. The material is air dried and then colored by admixture with 250 mg of the reaction product of triquinonyl with calcium carbonate in 40 mg of polyvinylene carbonate in 8 to 10 ml of acetone. The coloring material and resinous binder are brushed onto the sheet to cover the entire surface and then the colored sheet is sprayed with water to provide 30 to 40 mg of moisture, after which the sheet is shredded. The smoking mixture, when rolled into a cigarette and smoked, is extremely mild and gives very little acrid taste or undesirable odor.

EXAMPLE 4

The procedure of Example 3 was repeated except that an extract of tobacco stem material in solution in alcohol and water was applied to the thermally treated sheet before application of the coloring composition. The resulting sheets had a rich tobacco color and the texture and aroma of tobacco. When fabricated into a cigarette, the product gave a very mild smoke which was rich in the aroma of tobacco and which had good burning characteristics.

EXAMPLE 5

The process of Example 3 was repeated except that 750 mg of the treated shreds were admixed with 250 mg of cured natural tobacco and fabricated into a regular cigarette for smoking. The cigarette had all of the essential qualities of a cigarette formed of natural tobacco with 75% less tars and nicotine and polycyclic, aromatic and carbonyl compounds.

EXAMPLE 6

The procedure of Example 3 was followed except that the potassium bicarbonate was eliminated. The smoking material was the same as in Example 3 except that the ash was a bit flakier.

Example 7

The procedure of Example 3 was followed except that disodium hydrogen phosphate was eliminated. The smoking material was substantially the same except that it burned faster and less evenly with respect to the paper wrapper and the ash was not as easily flicked from the burned end.

EXAMPLE 8

The process of Example 1 is repeated except that thermal treatment is carried out under vacuum at a temperature of about 400°–500° C for 3–5 minutes.

EXAMPLE 9

The process of Examples 1 and 2 is repeated except that the cellulosic material is previously modified to contain 3–15% by weight of calcium oxalate and the thermal treatment is carried out for about 6 minutes at a temperature of about 350° C.

As described in the examples, the smokable material produced in accordance with the practice of this invention can be used alone as a tobacco substitute or it can be combined in various proportions with cured tobacco to produce a smokable product having reduced polycyclics, tars and nicotine.

It will be understood that changes may be made in the details of formulation and operation without departing from the spirit of the invention, especially as defined in the following claims.

I claim:

1. In the method of producing a smokable material, the steps of exposing a carbohydrate material selected from the group consisting of cellulose, cellulosic derivatives, starch, pectin, polyvinyl alcohol, gum and aliginates to a temperature of from about 350° to about 750° C for a time sufficient to effect a weight loss of at least about 50% but not more than 90%, said time being not more than about 10 minutes, maintaining the material in a non-oxidizing gas during the heat treatment, and then processing the thermally reacted product to a form desired for the smoking material.

2. The method as claimed in claim 1 which includes the step of adding an ashing ingredient to the thermally reacted carbohydrate material in an amount up to 30% by weight.

3. The method as claimed in claim 1 wherein the said processing includes adding to the thermally reacted carbohydrate material natural tobacco, tobacco extract, or reconstituted tobacco materials.

4. The method as claimed in claim 1 which includes the step of adding to the thermal reaction product a coloring agent or a flavoring agent.

5. The method as claimed in claim 1 which includes the step of adding to the thermally reacted carbohydrate material an ammonium salt, organic amine, or urea in an amount to adjust the pH within the range of 7 to 8.5.

* * * * *